United States Patent [19]

Lanius

[11] 4,387,805

[45] Jun. 14, 1983

[54] ARROWHEAD CASE AND ARROWHEAD WRENCH

[75] Inventor: Charles A. Lanius, Prairie du Sac, Wis.

[73] Assignee: Flambeau Corporation, Baraboo, Wis.

[21] Appl. No.: 260,895

[22] Filed: May 6, 1981

[51] Int. Cl.[3] ..... B65D 81/36; B65D 85/20

[52] U.S. Cl. ..... 206/230; 206/315 R; 206/317; 224/916; 273/422

[58] Field of Search ..... 206/3, 230, 317, 315 R; 224/916; 81/121 R, 90 C, 90 D; 220/20, 356; 273/421, 422, 416

[56] References Cited

U.S. PATENT DOCUMENTS

| | | | |
|---|---|---|---|
| 343,033 | 6/1886 | Jackson | 220/356 |
| 3,337,099 | 8/1967 | Rose | 224/916 |
| 4,093,230 | 6/1978 | Simo | 273/421 |

FOREIGN PATENT DOCUMENTS

| | | | |
|---|---|---|---|
| 650068 | 2/1951 | United Kingdom | 206/315 |

*Primary Examiner*—Joseph M. Moy
*Assistant Examiner*—Brenda J. Ehrhardt
*Attorney, Agent, or Firm*—Allegretti, Newitt, Witcoff & McAndrews, Ltd.

[57] ABSTRACT

An arrowhead case and arrowhead wrench. Both the arrowhead case and the arrowhead wrench include rib members. The rib members grippingly engage a shaft of an arrowhead between its blades and maintain the arrowhead in a predetermined position.

6 Claims, 10 Drawing Figures

ARROWHEAD CASE AND ARROWHEAD WRENCH

BACKGROUND OF THE INVENTION

The present invention relates generally to a case and more particularly to a case for holding arrowheads. The present invention also relates to a wrench for attaching an arrowhead to or removing an arrowhead from an arrow shaft.

Arrowheads, such as broadheads and field points, screw onto the end of an arrow shaft. To avoid denting and dulling of the arrowheads, it is customary practice among archery enthusiasts to remove the arrowheads from the shafts during periods of non-use, e.g., during transport.

Extra arrowheads are carried to replace dulled or damaged heads, or a change of target. Carrying the detached arrowheads in a protective case or container is particularly desirable when the archer must cross rough terrain. If the archer stumbles and falls, the case should prevent the arrowheads from being damaged or from causing bodily injury to the archer. At a minimum, the case must provide more protection than carrying assembled arrows in a quiver.

Unfortunately, the presently available arrowhead cases are poorly suited to meet the needs of the archery enthusiast. As a result, the archer often utilizes a simple closeable box or container. This type of case, however, totally fails to isolate the arrowheads, and dulling and denting of the razor-sharp blades will occur as the arrowheads knock against each other.

Another type of case is shown in U.S. Pat. No. 4,093,230. This sheath, however, is adapted to hold only a single arrowhead and offers very little protection against injury in case of a fall.

The archery enthusiast is also faced with the problem of securely fastening the arrowhead to the shaft prior to using the arrow. This is often done in the field and often must be done quickly.

Since the blades of the arrowhead are razor sharp, any attempt to tighten or loosen an arrowhead by hand and without heavy gloves is dangerous. Use of such gloves, on the other hand, is often cumbersome and can dull the blades. Conventional tools, such as pliers, may be used. However, such tools may result in a scarring of the arrow shank or damaging the arrowhead.

SUMMARY OF THE INVENTION

In a principal aspect, the present invention is a protective case for holding at least two arrowheads of a variety of head configurations having from 2 to 12 blades. The case includes a base adapted to receive the arrowheads. The base is closed by a cover.

The base is divided by an internal wall to define at least two isolated arrowhead compartments, thereby substantially avoiding contact between the arrowheads. Within each arrowhead compartment, the base includes four radially-disposed rib members each spaced 90° from its neighbor, and terminating in an inner edge for grippingly engaging the shank of the arrowhead between its blades. The arrangement allows for a variety of head configurations. So engaged, the arrowhead is securely held by the shaft with the blades out of contact with any surrounding surface. Thus, dulling due to contact between the arrowheads or between an arrowhead and the case is avoided.

The present invention also contemplates using the basic rib structure as a wrench for attaching an arrowhead to or removing an arrowhead from an arrow shaft. The wrench comprises a cylindrical housing of approximately square cross section, having a rib extending inwardly from each of the four housing walls, the inner edges of the ribs being spaced to receive the arrowhead shank. The rib members of the wrench, like the rib members of the arrowhead case, grippingly engage the arrowhead shank between its blades. As the wrench is turned, the rib members bear against the sides of the blades, thereby turning the arrowhead.

It is thus an object of the present invention to provide an improved compact protective case for arrowheads that will securely hold a plurality of arrowheads in spaced relation. Still another object is an arrowhead case capable of accommodating arrowheads having a variety of head configurations. In addition, it is an object of the present invention to provide a sturdily constructed arrowhead case resistive to compressing forces.

It is also an object of the present invention to provide an improved wrench for removing or replacing arrowheads on the arrow shaft. A further object is an arrowhead wrench which is compact, light-weight, and easy to use. Another object is a wrench that will accommodate many different types of arrowhead configurations, e.g. field points for target shooting, blunts or spring tips for birds or small game. It is another object to provide a wrench that engagingly holds and retains an arrowhead. Finally, it is an object to provide a readily and easily manufactured arrowhead wrench.

These and other objects, features, and advantages of the present invention are discussed or apparent in the following detailed description.

BRIEF DESCRIPTION OF THE DRAWING

Preferred embodiments of the present invention are described herein with reference to the drawing wherein.

DETAILED DESCRIPTION OF THE PREFERRED EMBODIMENTS

Figure 1:
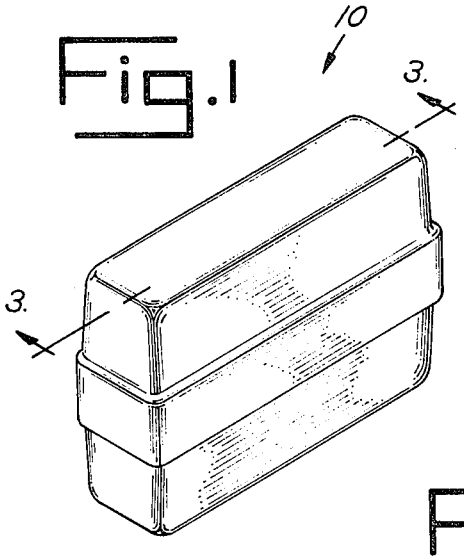
FIG. 1 is a perspective view of a preferred embodiment of the arrowhead case.
Figure 2:
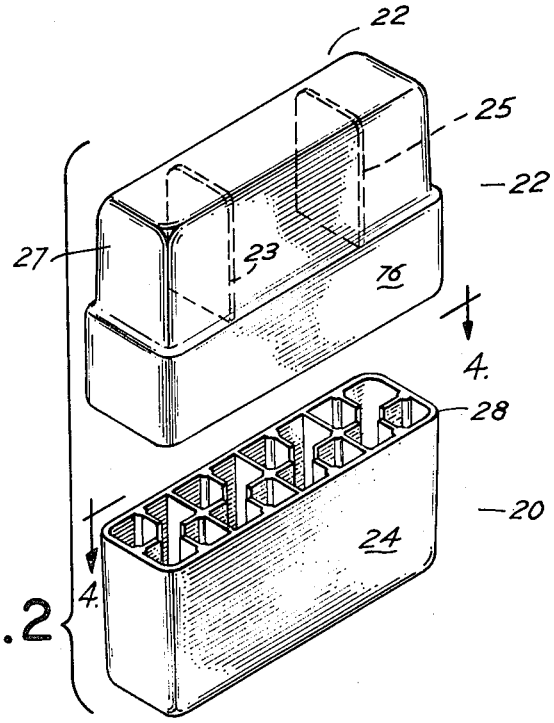
FIG. 2 is an exploded perspective view of the preferred embodiment shown in FIG. 1.
Figure 3:
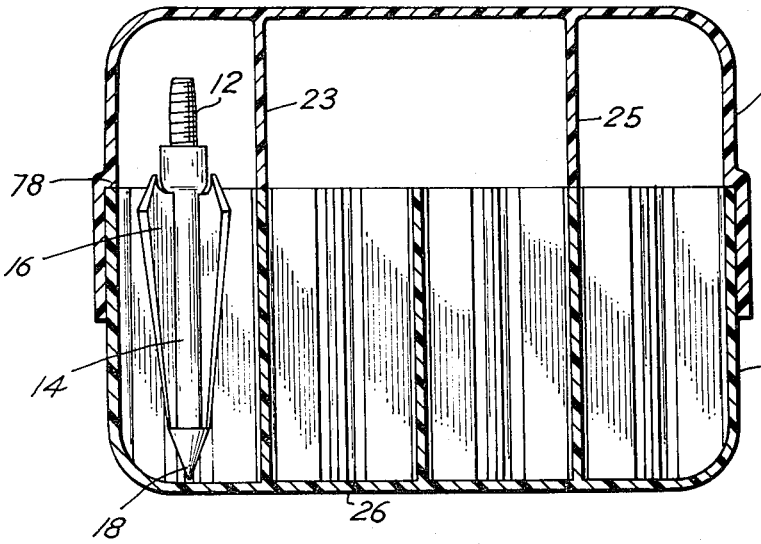
FIG. 3 is a cross-sectional view of the preferred embodiment shown in FIG. 1 taken along line 3—3.

Referring to FIGS. 1–5, a first preferred embodiment of the present invention is shown as an arrowhead case 10. The arrowhead case 10 is adapted to hold four arrowheads. For ease of illustration in FIGS. 3 and 4, only one arrowhead 12 is shown. The arrowhead 12 includes a central shank 14, blades 16 extending from the central shank 14, and a tip 18.

The case 10 includes a base 20 and a cover 22. Preferably, the base 20 and cover 22 are injection molded from thermoplastic resin. The cover 22 is adapted to receive and enclose the base 20. The cover 22 includes an offset peripheral portion 76, dimensioned to receive the base 20 in the closed state. The horizontal ledge portion 78 of this offset sets on the rim 28 of the base 20 and serves as a stop to limit the distance the base telescopes into the cover. A pair of transverse ribs 23, 25 is integrally molded with the cover which serve to rigidify the cover and supplement the ledge 78 as stops. The ribs 23, 25 are aligned with partition walls 30, 34 as described below.

The base 20 is substantially rectangular and includes a bottom wall 26 and a side wall 24, terminating in a rim 28.

The base 20 also includes three internal walls 30, 32, 34 secured to the side wall 24. The internal walls 30, 32, 34 extend transversely across the base 20 and divide the base 20 into four separate arrowhead compartments 36, 38, 40, 42. The number and configuration of the internal walls are merely illustrative.

Division of the base 20 by the internal walls 30, 32, 34 isolates the arrowheads 12 from each other. Contact that might otherwise dent or dull the arrowhead 12 is thereby substantially avoided. The internal walls 30, 32, 34 also add structural integrity to the base 20.

Figure 4:
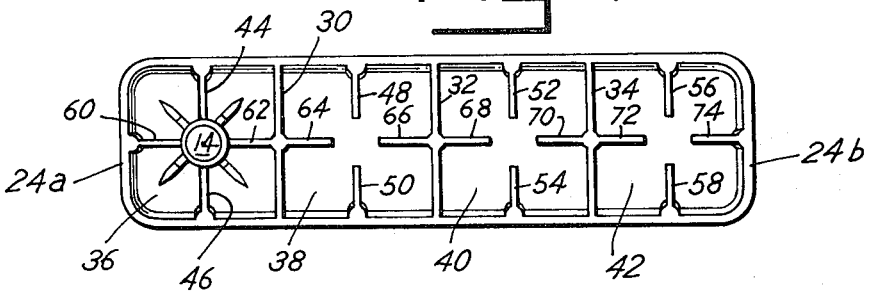
FIG. 4 is a top plan view of the base shown in FIG. 1.
Figure 5:
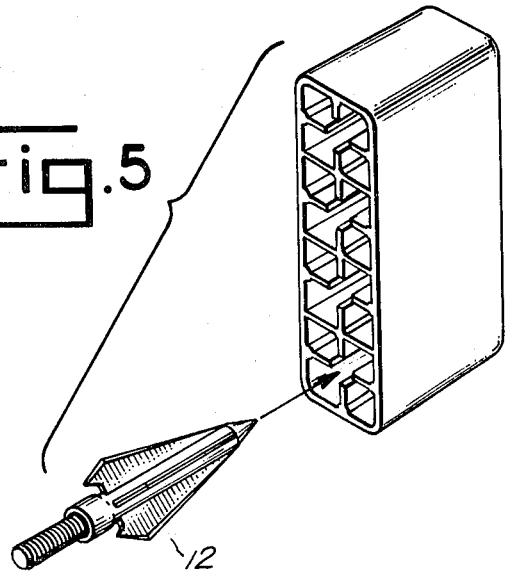
FIG. 5 is a perspective view of the base shown in FIG. 1.

As best shown in FIG. 4, each compartment includes two pairs of opposing rib members extending inwardly from the side wall 24 and from the transverse walls i.e. walls 24*a* and 30, forming the compartment. Such rib member 60, 44, 62, 46 of compartment 36 is spaced an equal distance from the center of the compartment to provide an opening defined by the inner edges of the ribs. The opening is dimensioned to the diameter of the arrowhead shank. Compartment 38 similarly has two pairs of ribs 48, 50 and 64, 66. Compartments 40, 42 are similarly structured.

Upon insertion of the arrowhead 12 into the opening defined by the opposed ribs of any compartment, the edges of the ribs grippingly engage the central shank 14 of the arrowhead 12. This engagement securely holds and retains the arrowhead 12 within the compartment. The longitudinal rib members 60–74 and the transverse rib members 44–58 extend vertically from the bottom wall 26 to the rim 28 of the base 20. Ribs 30 and 34 are aligned with ribs 23, 25 in the cover and thus support the top wall of the cover when in place on the base.

These ribs, together with the side wall 27 which bears on the rim 28, provide safety in the event of a fall. Should the archer stumble upon the arrowhead case 10, the base will not push up into the cover to a point where the arrowheads 12 will pierce the bottom wall 26, and expose the sharp tip 18.

The overlapping of the base 20 by the peripheral skirt 76 of the cover 22 provides a double-wall construction and avoids puncture or cutting through the case walls by the blades 16 of the arrowhead 12 under a compressive force.

Figure 6:
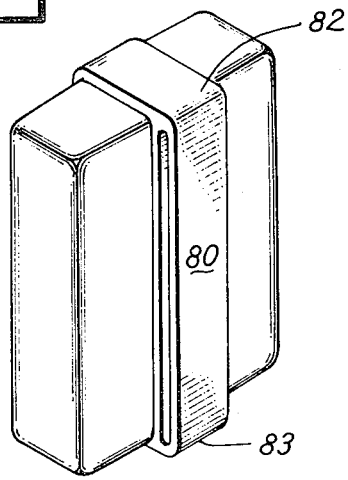
FIG. 6 is still another perspective view of the preferred embodiment shown in FIG. 1 illustrating the belt loop thereof.
Figure 7:
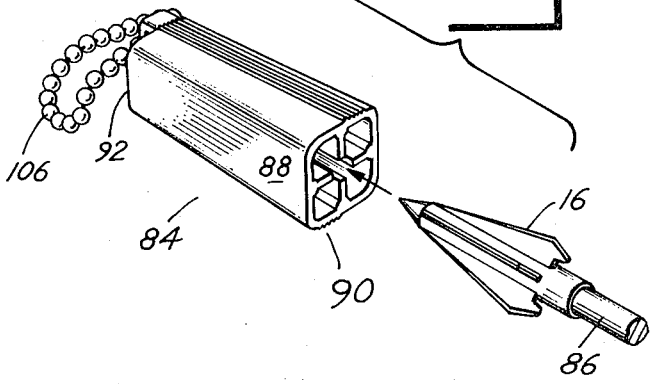
FIG. 7 is a perspective view of a preferred embodiment of the arrowhead wrench.

In an alternative construction shown in FIG. 6, the cover 22 may include an integral in-molded belt loop 80. The integral belt loop 80 extends from one end 82 to the other end 83 of the cover 22, parallel to and slightly spaced from the offset peripheral skirt 76. The loop 80 permits the archery enthusiast to conveniently attach the case to his clothing.

A second embodiment of the present invention is shown in the form of an arrowhead wrench 84. The arrowhead wrench 84 facilitates threading the razor-sharp arrowhead 12 on to and off of an arrow shaft 84. The wrench comprises a cylindrical housing 88 having a substantially square cross-section. The housing is the full equivalent of one compartment, e.g. 36 in FIG. 4, of the case base 20. The housing 88 also is preferably injection molded thermoplastic and defines a closed end 92 and an open end 90 adapted to receive the arrowhead 12. The length of the housing 88 is sufficient to enclose the arrowhead 12.

Figure 8:
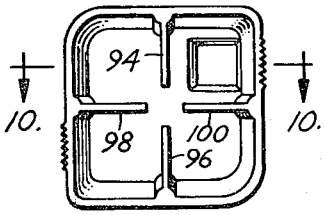
FIG. 8 is a front view of the preferred embodiment shown in FIG. 7.
Figure 9:
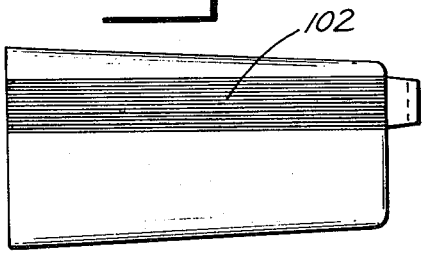
FIG. 9 is a side view of the preferred embodiment shown in FIG. 7.

Similar to the arrowhead case 10, the housing 88 includes two pairs of opposing rib members 94, 96 and 98, 100 as best shown in FIG. 8. The rib members 94, 96 and cross members 98, 100 extend inwardly from the four walls of housing 88 and are perpendicular thereto, each rib also being disposed at 90° to the adjacent ribs. Each rib terminates short of the center of the compartment to provide an opening for the arrowheads 12. Upon insertion of the arrowhead into the housing 88, the rib members 94, 96 and cross rib members 98, 100 grippingly engage the central shank 14 of the arrowhead 12, securely holding and retaining the arrowhead 12 within the wrench housing 88.

To attach arrow shaft 86 to the arrowhead 12, the arrowhead is inserted in the opening formed by the inner edges of the ribs of wrench 84 and the wrench is rotated to engage the threads. As additional tightening force is required, the wrench 84 rotates with respect to arrowhead 12 until the rib members 94, 96 and/or the cross members 98, 100 (depending upon the number of arrowhead blades 16) engage the blades 16. This engagement permits application of a greater torsional force to the arrowhead 12, to securely fasten it to the arrow shaft 86.

The arrowhead wrench 84 substantially avoids the use of cumbersome gloves or other tools that might damage the arrowhead 12, but at the same time avoids handling it with bare hands. Further, the housing 88 includes serrations 102 on the outer surface thereof to facilitate manual gripping.

Figure 10:
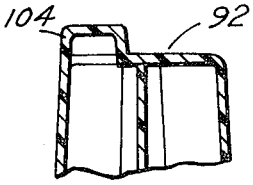
FIG. 10 is a partial cross-sectional view of the preferred embodiment shown in FIG. 8 taken along line 10—10.

As shown in FIG. 10, a portion of the closed end 92 of the housing 88 may be turned out to define an eyelet 104. The eyelet 104 is adapted to receive a key chain 106 for conveniently attaching the arrowhead wrench 84 to one's clothing.

Because of the similarities in construction the case 10 may be used as a wrench although not as conveniently as the separate wrench 84.

Two preferred embodiments of the present invention have been described herein. It is to be understood, however, that changes and modifications may be made in the embodiments without departing from the true scope and spirit of the present invention as defined by the appended claims.

What is claimed is:

1. A protective case for arrowheads, each arrowhead having a central shank, a plurality of radially-extending blades and a tip, comprising, in combination:

a base adapted to receive said arrowheads, said base having a bottom wall, a side wall, defining a rim, an internal wall dividing said base into arrowhead compartments, and two pairs of opposed rib members within each of said compartments, each rib being disposed at approximately 90° to adjacent ribs and terminating in an inner edge to grippingly engage said shank of said arrowhead between said blades, whereby said arrowhead is retained within said compartment, isolated from other arrowheads in the case thereby avoiding dulling of said tip and said blades; and a cover adapted to receive and enclose said base and the arrowheads therein, said cover including an offset peripheral portion defining an interior ledge, said rim of said base abutting said interior ledge when the case is closed to resist a compressing force applied to said case, and a transverse rib which is aligned and abuts said internal dividing wall, thereby further increasing the resistance of the case to compression forces.

2. The case of claim 1 wherein each rib member is attached to a side wall defining said compartment and extends inwardly therefrom.

3. The case of claim 2 wherein said rib members are substantially perpendicular to said side wall and said dividing wall.

4. A wrench for use with an arrowhead having a central shank and a plurality radially-extending blades comprising, in combination: a cylindrical housing of substantially square cross section having two pairs of opposing rib members attached to the walls of said housing and terminating in an inner edge to grippingly engage said shank of said arrowhead between said blades, whereby a torsional force manually applied to said housing is transferred to said arrowhead retained within said housing.

5. The wrench of claim 4 wherein said rib members are substantially perpendicular to the walls of said housing and are disposed at 90° to each other.

6. A wrench as claimed in claim 4 wherein said housing defines an open end and a closed end and said rib members extend from said open end to said closed end.

* * * * *